United States Patent [19]

Schoennagel et al.

[11] 4,264,428

[45] * Apr. 28, 1981

[54] CONVERSION OF COAL INTO LIQUID FUELS

[75] Inventors: Hans-Juergen Schoennagel, Lawrenceville; John C. Zahner, Princeton, both of N.J.

[73] Assignee: Mobil Oil Corporation, Fairfax, Va.

[ * ] Notice: The portion of the term of this patent subsequent to Aug. 22, 1995, has been disclaimed.

[21] Appl. No.: 103,250

[22] Filed: Dec. 13, 1979

Related U.S. Application Data

[60] Continuation of Ser. No. 887,590, Mar. 17, 1978, which is a division of Ser. No. 777,486, Mar. 14, 1977, Pat. No. 4,108,758.

[51] Int. Cl.[3] ..... C10G 1/00; C10G 1/06; C10G 51/06

[52] U.S. Cl. ..... 208/8 LE; 208/10; 208/78

[58] Field of Search ..... 208/8 LE, 10, 78

[56] References Cited

U.S. PATENT DOCUMENTS

| | | | |
|---|---|---|---|
| 3,974,062 | 8/1976 | Oven et al. | 208/251 R X |
| 4,035,281 | 7/1977 | Espenscheid et al. | 208/8 LE |
| 4,108,758 | 8/1978 | Schoennagel et al. | 208/10 X |

*Primary Examiner*—Delbert E. Gantz
*Assistant Examiner*—William G. Wright
*Attorney, Agent, or Firm*—Charles A. Huggett; Charles J. Speciale

[57] ABSTRACT

This invention provides an improved process for deriving liquid fuels from coal which involves the steps of (1) solubilizing coal in a FCC residual oil to form a solvated coal solution phase and an ash solids phase; (2) subject the two phase admixtureto FCC conversion conditions; (3) separating and recovering a hydrocarbon phase and a catalyst-ash solids phase in a catalyst-ash solids phase; (4) treating the catalyst-ash solids phase in a catalyst regeneration zone, and removing entrained ash solids from the flue gas effluent of the catalyst regeneration zone; and (5) fractioning the hydrocarbon phase to recover liquid fuel products.

2 Claims, 1 Drawing Figure

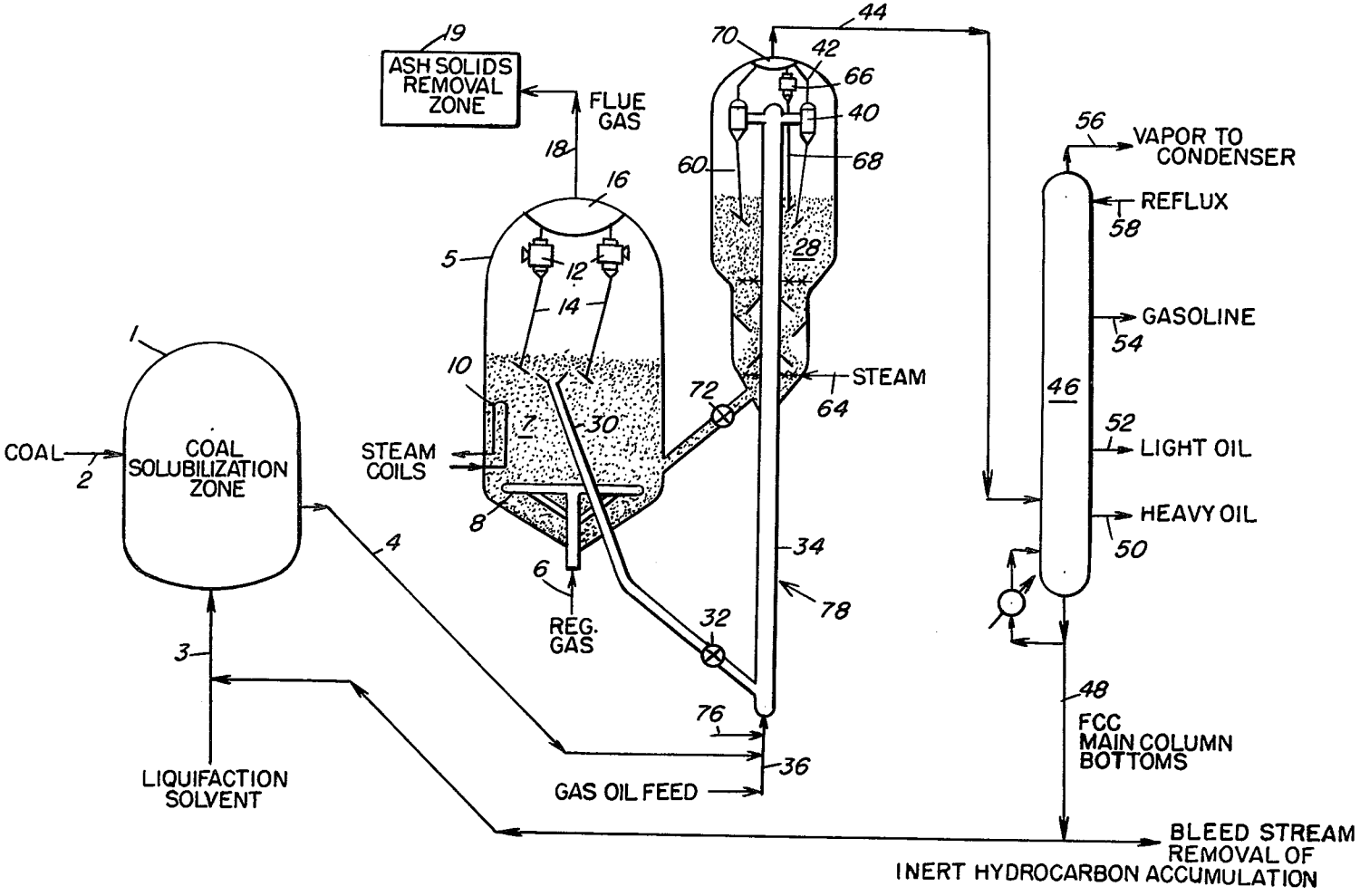
VAPOR TO CONDENSER
REFLUX
GASOLINE
LIGHT OIL
HEAVY OIL
FCC MAIN COLUMN BOTTOMS
BLEED STREAM REMOVAL OF INERT HYDROCARBON ACCUMULATION
STEAM
FLUE GAS
ASH SOLIDS REMOVAL ZONE
REG. GAS
GAS OIL FEED
STEAM COILS
COAL SOLUBILIZATION ZONE
LIQUIFACTION SOLVENT
COAL

CONVERSION OF COAL INTO LIQUID FUELS

CROSS-REFERENCE TO RELATED APPLICATIONS

This application is a continuation of copending application Ser. No. 887,590, filed Mar. 17, 1978 as a division of application Ser. No. 777,486, filed on Mar. 14, 1977, now U.S. Pat. No. 4,108,758, dated Aug. 22, 1978.

BACKGROUND OF THE INVENTION

It was recognized by early workers that coal can be liquified by controlled heating in the substantial absence of oxygen. The conversion products are a liquid and a char. Because of the new compelling economic factors, the technology of coal liquefaction and gasification has been expending at an accelerated pace. Pioneer developments in the field are represented by Largi and Fischer-Tropsch technology. More recent advances in coal liquefaction are described in U.S. Pat. Nos. 1,904,586; 1,955,041; 1,996,009; 2,091,354; 2,174,184; 2,714,086; 3,375,188; 3,379,638; 3,607,718; 3,640,816; 3,642,608; 3,705,092; 3,849,287; 3,870,621; inter alia.

Hence, by recently developed methods, coal can be converted into hydrocarbon liquids by subjecting coal to reaction with solvents, with or without hydrogen, to yield a slurry mixture of dissolved coal and a residuum of unreacted coal and mineral ash. The solids are present in the slurry as a finely divided suspension of insoluble matter.

The suspended solids have a high content of ash which reduces the value of the slurry as a fuel and limits its use to special situations. For this reason, it is normal procedure in coal liquefaction operations to separate the undesirable finely divided solids prior to further processing of coal liquefaction products.

The procedure for separating the solids from the coal liquefaction solvent phase has been a serious economic disadvantage in coal liquefaction processes. The fine particle size characteristic of the suspended solids creates formidable difficulties in the application of conventional separation techniques such as filtration, centrifugation, and settling.

Existing filtration techniques are unattractive because of slow filtration rates and plugging of filters.

Gravity settling techniques have limited application because of slow settling rates and inefficient ash removal.

Centrifugation techniques for removing the suspended solids have the disadvantage of high equipment and operating costs.

Because of the deficiencies of conventional separation techniques, there remains a need for an effective method for separating finely divided solids from the solvent-rich extract phase of solvated coal either prior or during further upgrading procedures such as catalytic cracking.

Accordingly, it is an object of the present invention to provide an economical method for separating the finely divided suspension of ash solids from the solvent-rich extract phase of a coal liquefaction product.

It is another object of this invention to provide an improved process for converting coal into liquid derivatives having application as fuels.

It is a further object of this invention to upgrade low value refractory petroleum residua from refinery operations into liquid fuel and other high value commercial products.

Other objects and advantages of the present invention shall become apparent from the accompanying drawing and description.

DESCRIPTION OF THE INVENTION

One or more objects of the present invention are accomplished by the provision of an improved process for coal conversion into motor fuel and other low boiling hydrocarbon products by catalytic cracking, which process comprises (1) solubilizing coal in fluidized catalytic cracking main column bottoms residual oil to form a solvated coal solution containing a suspension of ash solids, (2) charging the solvated coal solution and suspended ash solids to a fluidized catalytic cracking conversion zone in admixture with gas oil feed, (3) separating and recovering a hydrocarbon phase and a catalyst-ash solids phase from the catalytic cracking conversion zone effluent, (4) passing the catalyst-ash solids phase into a catalyst regeneration zone, and (5) removing entrained ash solids from the flue gas effluent of the catalyst regeneration zone with a fines recovery system.

In step (1) of the invention process, the residual oil solvent and comminuted coal are admixed to form a slurry. The slurry thus formed is heated at a temperature in the range between about 350° F. and 850° F., and preferably at a temperature between about 500° F. and 800° F.

Although it is not required, the coal liquefaction reaction can be conducted under pressure and/or in the presence of a reducing gas. Hence, the coal solubilization preferably is conducted in a closed system under moderate or high hydrogen pressure, with or without the presence of a hydrogenation catalyst. The hydrogen pressure is maintained in the range between about 500 and 5000 psi, and preferably in the range between about 1000 and 3000 psi.

The coal solubilization step (1) of the process is normally conducted for a period of time between about 0.2 and 3 hours, and preferably for a period of time between about 0.5 and 1.5 hours until substantially all of the comminuted coal is dissolved.

The residual oil solvent is provided in a quantity between about 0.5 and 10 parts by weight per part by weight of the comminuted coal component. Normally, the preferred ratio will be in the range between about 1 and 5 parts by weight of residual oil solvent per part by weight of coal.

Step (1) Coal Component

The invention process is generally applicable for the liquefaction of carbonaceous materials such as bituminous and sub-bituminous types of coal. The nominal analyses of various coals suitable for use in the invention process are as follows:

| | |
|---|---|
| **High Volatile A** | |
| Sulfur | 1.33% |
| Nitrogen | 1.63 |
| Oxygen | 7.79 |
| Carbon | 80.88 |
| Hydrogen | 5.33 |
| Ash | 2.77 |
| **Sub-Bituminous** | |
| Sulfur | 0.21% |
| Nitrogen | 0.88 |
| Oxygen | 15.60 |
| Carbon | 65.53 |

-continued

| | |
|---|---|
| Hydrogen | 5.70 |
| Ash | 3.99 |
| Lignite | |
| Sulfur | 0.53% |
| Nitrogen | 0.74 |
| Oxygen | 32.04 |
| Carbon | 54.38 |
| Hydrogen | 5.42 |
| Ash | 5.78 |

Ball mills or other types of conventional apparatus may be employed for pulverizing coarse coal in the preparation of the comminuted feed coal for the liquefaction step of the process. The crushing and grinding of the coal can be accomplished either in a dry state or in the presence of a liquid such as the coal liquefaction solvent being employed in the practice of the invention process. The average particle diameter of the feed coal is preferably below about 0.05 inches.

Step (1) Coal Liquefaction Solvent

The residual oil solvent medium employed in step (1) of the process is a thermally stable, highly polycyclic aromatic mixture which performs as a hydrogen-donor solvating medium. Nominally it has a boiling point in the range between about 550° F. and 1100° F. It is a preferred feature of the present invention process that the coal liquefaction solvent is a residual slurry oil derived from fluidized catalytic cracking main column bottoms.

A FCC main column bottoms residuum is recovered as a slurry containing a suspension of catalyst fines. The "slurry oil" is directly suitable for use as a liquefaction solvent in the invention process, or it can be subjected to further treatment to yield a "clarified slurry oil". The further treatment can involve introducing the hot slurry oil into a slurry settler unit in which it is contacted with cold heavy cycle oil to facilitate settling of catalyst fines out of the slurry oil. The overhead liquid effluent from the slurry settler unit is the said "clarified slurry oil". A more detailed description of the production and recovery of FCC main tower bottoms residual oil is disclosed in U.S. Pat. No. 3,725,240.

A typical clarified slurry oil has the following nominal analysis and properties:

| | | |
|---|---|---|
| Elemental Analysis, Wt. % | | |
| C | | 89.93 |
| H | | 7.35 |
| O | | 0.99 |
| N | | 0.44 |
| S | | 1.09 |
| Total | | 99.80 |
| Pour Point, °F.: 50 | | |
| Distillation: | | |
| IBP, | °F.: | 490 |
| 5%, | °F.: | 640 |
| 95%, | °F.: | 905 |

A typical FCC main column bottoms residual oil contains a mixture of chemical constituents as represented in the following mass spectrometric analysis:

| Compounds | Aromatics | Naphthenic Aromatics |
|---|---|---|
| Alkyl-Benzenes | 0.4 | |
| Naphthene-Benzenes | | 1.0 |
| Dinaphthene-Benzenes | | 3.7 |
| Naphthalenes | 0.1 | |
| Acenaphthenes, (biphenyls) | | 7.4 |
| Fluorenes | | 10.1 |
| Phenanthrenes | 13.1 | |
| Naphthene-phenanthrenes | | 11.0 |
| Pyrenes, fluoranthenes | 20.5 | |
| Chrysenes | 10.4 | |
| Benzofluoranthenes | 6.9 | |
| Perylenes | 5.2 | |
| Benzothiophenes | 2.4 | |
| Dibenzothiophenes | 5.4 | |
| Naphthobenzothiophenes | | 2.4 |
| Total | 64.4 | 35.6 |

A FCC main column bottoms residual oil is an excellent liquefaction solvent medium for coal solubilization because it has a unique combination of physical properties and chemical constituency. A critical aspect of solvating ability is the particular proportions of aromatic and naphthenic and paraffinic moieties characteristic of a prospective coal liquefaction solvent. A high content of aromatic and naphthenic structures in a solvent is a criterion for high solvating ability for coal liquefaction.

Step (2) Fluidized Catalytic Cracking

In a "fluidized catalytic cracking" process (or FCC) catalyst particles are used which are generally in the range of 10 to 150 microns in diameter. The commercial FCC processes include one or both of two types of cracking zones, i.e., a dilute bed (or "riser") and a fluid (or dense) bed. Useful reaction conditions in fluid catalytic cracking include temperatures above 850° F., pressures from subatmospheric to 3 atmospheres, catalyst-to-oil ratios of 1 to 30, oil contact time less than about 12 to 15 seconds in the "riser", preferably less than about 6 seconds, wherein up to 100% of the desired conversion may take place in the "riser", and a catalyst residence (or contact) time of less than 15 minutes, preferably less than 10 minutes, in the fluidized (or dense) bed.

The catalyst employed in the FCC reactor is preferably characterized by a low sodium content and is an intimate admixture of a porous matrix and a crystalline aluminosilicate zeolite, the cations of which consist essentially, or primarily, of metal characterized by a substantial portion of rare earth metal, and a structure of rigid three-dimensional networks characterized by pores having a minimum cross-section of 4 to 15 Angstroms, preferably between 6 and 15 Angstrom units extending in three dimensions.

The crystalline aluminosilicate catalyst is intermixed with a material which dilutes and tempers the activity thereof so that currently available cracking equipment and methods may be employed. In a preferred embodiment, there are utilized materials which do more than perform a passive role in serving as a diluent, surface extender or control for the highly active zeolite catalyst component. The highly active crystalline aluminosilicate zeolite catalyst is combined with a major proportion of a catalytically active material which, in such combination, enhances the production of gasoline of higher octane values, while concomitantly providing a composite catalyst composition which may be used at much higher space velocities than those suitable for other types of catalysts, and which composite catalyst composition also has greatly superior properties of product selectively and steam stability.

The crystalline aluminosilicates employed in preparation of catalysts may be either natural or synthetic zeolites. Representative of particularly preferred zeolites are the faujasites, including the synthetic materials such as Zeolite X described in U.S. Pat. No. 2,882,244; Zeolite Y described in U.S. Pat. No. 3,130,007; as well as other crystalline aluminosilicate zeolites having pore openings of between 6 and 15 Angstroms. These materials are essentially the dehydrated forms of crystalline hydrous siliceous zeolites containing varying quantities of alkali metal and aluminum, with or without other metals. The alkali metal atoms, silicon, aluminum and oxygen in these zeolites are arranged in the form of an aluminosilicate salt in a definite and consistent crystalline pattern. The structure contains a large number of small cavities interconnected by a number of still smaller holes or channels. These cavities and channels are uniform in size. The alkali metal aluminosilicate used in preparation of the present catalyst has a highly ordered crystalline structure characterized by pores having openings of uniform sizes within the range greater than 4 and less than 15 Angstroms, preferably, between 6 and 15 Angstroms, the pore openings being sufficiently large to admit the molecules of the hydrocarbon charge desired to be converted. The preferred crystalline aluminosilicates will have a rigid three-dimensional network characterized by a system of cavities and interconnecting ports or pore openings, the cavities being connected with each other in three dimensions by pore openings or ports which have minimum diameters of greater than 6 Angstrom units and less than 15 Angstrom units. A specific typical example of such a structure is that of the mineral faujasite.

Separation And Recovery Procedures

The effluent from the step (2) catalytic cracking conversion zone is subjected to a separation procedure for removal of the suspended catalyst and ash particles from the hydrocarbon stream. As illustrated in the FIGURE, cyclone separations are a preferred means.

The hydrocarbon phase which is obtained from this separation procedure is passed into a main column fractionator wherein the hydrocarbon product stream is separated into heavy oil recycle fractions, middle gasoline fractions, and light end fractions. A portion of the heavy oil fractions can be recycled to the coal solubilization step (1) of the process, or a portion of the heavy oil fractions can be recycled to the hydrocarbon cracking step (2) of the process. As described hereinabove, the main column bottoms residual oil is recycled to step (1) of the process.

The separated catalyst-ash solids can be collected as a dense fluid bed of particles. In step (4) of the invention process, the separated catalyst-ash solids can be passed into a catalyst regeneration zone in accordance with the procedures described in U.S. Pat. No. 3,886,060. Regenerated catalyst is recycled to the fluidized catalytic cracking conversion zone in a conventional manner.

substantially all of the ash in the catalyst regeneration zone is in the form of finely divided powder, which exits from the catalyst regeneration zone as entrained particles in the flue gas. The entrained ash particles are separated from the flue gas by electrostatic precipitation or other suitable means. The ash solids are thereby removed from the coal solubilization/catalytic cracking cycle of the invention process.

DESCRIPTION OF THE DRAWING

The FIGURE illustrates in elevation a side-by-side arrangement of vessels with interconnecting transfer conduits for effecting catalytic conversion of hydrocarbons, regeneration of a hydrocarbon conversion catalyst, removal of ash fines, and transfer of catalyst particles within the system.

DISCUSSION OF SPECIFIC EMBODIMENTS

Referring to the FIGURE, comminuted coal is charged to coal solubilization zone 1 through conduit 2, where it is slurried with a residual oil liquefaction solvent which is introduced into coal solvation zone 1 via conduit 3. After the coal solubilization heating phase is completed under conditions described hereinabove, the solvated coal solution containing suspended ash solids is withdrawn from zone 1 through conduit 4 and admixed with gas oil feed in conduit 36. In another embodiment, the solvated coal solution and the gas oil feed are cracked in separate conversion zones, and the catalyst and ash solids phase recovered from each conversion zone are both passed into a common catalyst regeneration zone.

In the FIGURE, there is also illustrated a side-by-side reactor-regeneration system with a product fractionator for converting the hydrocarbon feed materials in the presence of catalyst compositions comprising crystalline aluminosilicate conversion catalysts as more fully described in U.S. Pat. Nos. 3,886,060 and 3,926,843.

In the FIGURE arrangement of vessels, a regenerator 5 containing a bed of finely divided catalyst particles is maintained in a fluidized condition by regeneration gas introduced to the bottom portion of the fluid bed by conduit 6 and communicating with a regeneration gas distributor grid 8. Coils 10 for generating process steam are provided in the regeneration zone. Cyclone separators 12 with diplegs 14 are provided in the upper portion of the regenerator for separating and returning to the catalyst bed entrained catalyst fines from regeneration flue gas. The separated flue gases pass into plenum chamber 16 and are withdrawn therefrom by conduit 18. During regeneration of the catalyst in fluid bed 7, carbonaceous material deposits on the catalyst are removed by burning in the presence of oxygen-containing regeneration gas thereby raising the temperature of the catalyst to 1,000° F. and more, usually to a temperature in the range of 1,200° F. up to about 1,400° F.

The flue gas effluent in conduit 18 is entered into fines recovery system 19. By means of a cyclone or electrostatic precipitator or other conventional equipment, entrained catalyst fines and powdered ash solids are removed from the flue gas. Coal ash is dimensionally fragile, and readily attrites to a fine powder during the catalytic cracking and catalyst regeneration phases of the invention process. Substantially all of the coal ash solids are entrained in the flue gas and are removed from the processing cycle by fines recovery system 19.

Regenerated catalyst is withdrawn from bed 7 by withdrawal conduit 30 provided with catalyst flow control valve 32 for passage to the inlet of riser reactor 34.

To accomplish the catalytic conversion of the above-described hydrocarbon stocks, the present invention process can employ the procedure of initially contacting freshly regenerated catalyst at an elevated temperature of at least 900° F. with a hydrocarbon feed mixture introduced by conduit 36 to risers 34 to provide a reaction residence time in the presence of suspended catalyst passing up the riser in the range of from about 1 to 12 seconds. The catalyst oil suspension is separated in separators 40 into a hydrocarbon phase and a catalyst phase. The hydrocarbon phase is withdrawn from the separators by conduit 42 and then passed by conduit 44 to a product fractionator 46 wherein products of conversion are separated into a FCC main column bottoms fraction withdrawn by conduit 48, a heavy oil recycle fraction withdrawn by conduit 50, a light oil recycle fraction withdrawn by conduit 52, a heavy gasoline fraction withdrawn by conduit 54, and materials boiling below the separated gasoline fraction withdrawn by conduit 56. The vaporous material withdrawn by conduit 56 is passed to a condenser wherein reflux materials are separated for return to the tower as reflux by conduit 58.

Catalyst and ash solids separated from hydrocarbon vapors in cyclone separators 40 are conveyed by diplegs 60 to a collected dense fluid bed of catalyst 28 therebelow.

The fluid bed of catalyst 28 is caused to move generally downwardly into and through a catalyst stripping zone in countercurrent contact with stripping gas such as steam introduced to a lower portion thereof by conduit 64. Stripped hydrocarbon products and stripping gas are removed from the upper portion of fluid bed 28 and pass through one or more cyclone separators represented by separator 66. Separated catalyst is returned to the catalyst bed as by dipleg 68 with the separated vaporous material passing into a plenum chamber 70 from which the vapors are withdrawn by conduit 44.

Stripped catalyst and ash solids obtained as above defined are then passed by conduit 72 provided with catalyst flow control valve 74 to a bed of catalyst 7 in the regeneration zone, thus completing the primary circulation of catalyst through and between the regeneration zone and the hydrocarbon conversion zones.

Additional provisions can be made for adding a diluent hydrocarbon stream to the hydrocarbon feed stock through conduit 76. Also, the processing advantages of this invention may be enhanced by subjecting the oil feed to a prehydrogenation treatment prior to the cracking thereof in riser 34. Prehydrogenation of the oil feed will operate to reduce the coke-forming characteristics of the oil charge by hydrogenating polycyclic aromatics in the charge. Also, the prehydrogenation of the oil feed will reduce to a considerable extent metal contaminants in the oil feed.

It is also contemplated charging low octane light virgin naphtha, atmospheric gas oil and heavy virgin naphtha to the risers above identified to form alkylate feed material in addition to producing high octane gasoline during high temperature cracking (of at least 1,000° F.) of these feed materials. For example, the high catalyst-to-oil ratios in combination with high catalyst temperature and relatively short hydrocarbon residence time is particularly suitable for accomplishing the results desired. It is also contemplated charging coker naphtha or low octane reformate material [such as 90 to 95 R+O (Research clear) octane material ] to such a high temperature riser cracking zone to raise the octane level thereof in combination with producing alkylate feed material.

Having thus provided a general discussion of the improved methods and systems of the present invention and described specific examples in support thereof, it is to be understood that no undue restrictions are to be imposed by reason thereof except as defined by the following claims.

What is claimed is:

1. In a process for preparation of liquid fuels from coal by solvation of comminuted coal in a liquid hydrocarbon solvent derived in the process as hereinafter defined and in the presence of hydrogen, subjecting products from said solvation step to fluidized catalytic cracking with a solid cracking catalyst whereby an inactivating carbonaceous deposit is laid down on the catalyst, separating cracked hydrocarbon products from catalyst so inactivated, regenerating said separated inactivated catalyst by fluidizing the same in air to burn the said carbonaceous deposit, separating flue gas resultant from said burning, returning the so regenerated catalyst to the fluidized catalytic cracking step, fractionating said cracked hydrocarbon products to provide a bottoms fraction which is a thermally stable, highly polycyclic aromatic residual oil, transferring said residual oil to said solvation step as the liquid hydrocarbon solvent therein and separating ash derived from said coal from hydrocarbons during the said process; the improvement in separating ash from hydrocarbons which comprises subjecting said solvation products admixed with ash derived in said solvation step to fluidized catalytic cracking as aforesaid, separating the said ash admixed with inactivated catalyst from cracked hydrocarbon products, subjecting the mixture of ash and inactivated catalyst to said regeneration step, removing ash from said regeneration step with said flue gas, and separating said ash from said flue gas.

2. The process of claim 1 wherein a gas oil is cracked in a fluidized catalytic cracking step apart from cracking of said products from the solvation step and the products of cracking said gas oil are mixed with said cracked hydrocarbon from said cracking of said products of said solvation step for fractionation as aforesaid.

* * * * *